US005755555A

United States Patent [19]

Swift

[11] Patent Number: 5,755,555

[45] Date of Patent: May 26, 1998

[54] ROTATING FAN HAVING TAPERED DISK COMPONENT

[75] Inventor: Robert O. Swift, Stow, Ohio

[73] Assignee: Ametek, Inc., Kent, Ohio

[21] Appl. No.: 643,974

[22] Filed: May 7, 1996

Related U.S. Application Data

[63] Continuation of Ser. No. 344,144, Nov. 23, 1994, abandoned.

[51] Int. Cl.[6] ..... F04D 29/44

[52] U.S. Cl. ..... 415/206; 415/228; 416/223 B

[58] Field of Search ..... 416/186 R, 185, 416/223 B; 415/185, 206, 227, 228

[56] References Cited

U.S. PATENT DOCUMENTS

| | | | |
|---|---|---|---|
| 253,267 | 2/1882 | Davidson | 416/186 R |
| 1,672,986 | 6/1928 | McKee | 415/206 |
| 2,899,129 | 8/1959 | Schwaiger | 416/186 R |
| 2,997,959 | 8/1961 | Allen | 416/186 R |
| 3,107,625 | 10/1963 | Amberg | 416/186 R |
| 3,225,422 | 12/1965 | Sebok | 416/186 R |
| 3,692,428 | 9/1972 | Bubb et al. | 416/188 |

FOREIGN PATENT DOCUMENTS

| | | | |
|---|---|---|---|
| 2627344 | 12/1977 | Germany | 416/186 R |
| 872552 | 7/1961 | United Kingdom | 416/186 R |

*Primary Examiner*—John T. Kwon

*Attorney, Agent, or Firm*—Renner, Kenner, Greive, Bobak, Taylor & Weber

[57] ABSTRACT

A rotating fan assembly is provided for use in single stage and multi-stage applications. The fan assembly includes a fan member having a tapered disk member, a flat annular ring member and a plurality of blade members interposed between the disk and the ring. The fan member may be housed in an enclosure shroud having a tapered case and a flat shell member thereby reducing case length from start of the shell to the inlet plane. The flat shell member doubles as a shroud for both the rotating fan member and for a stationary fan when used in multi-stage designs.

4 Claims, 5 Drawing Sheets

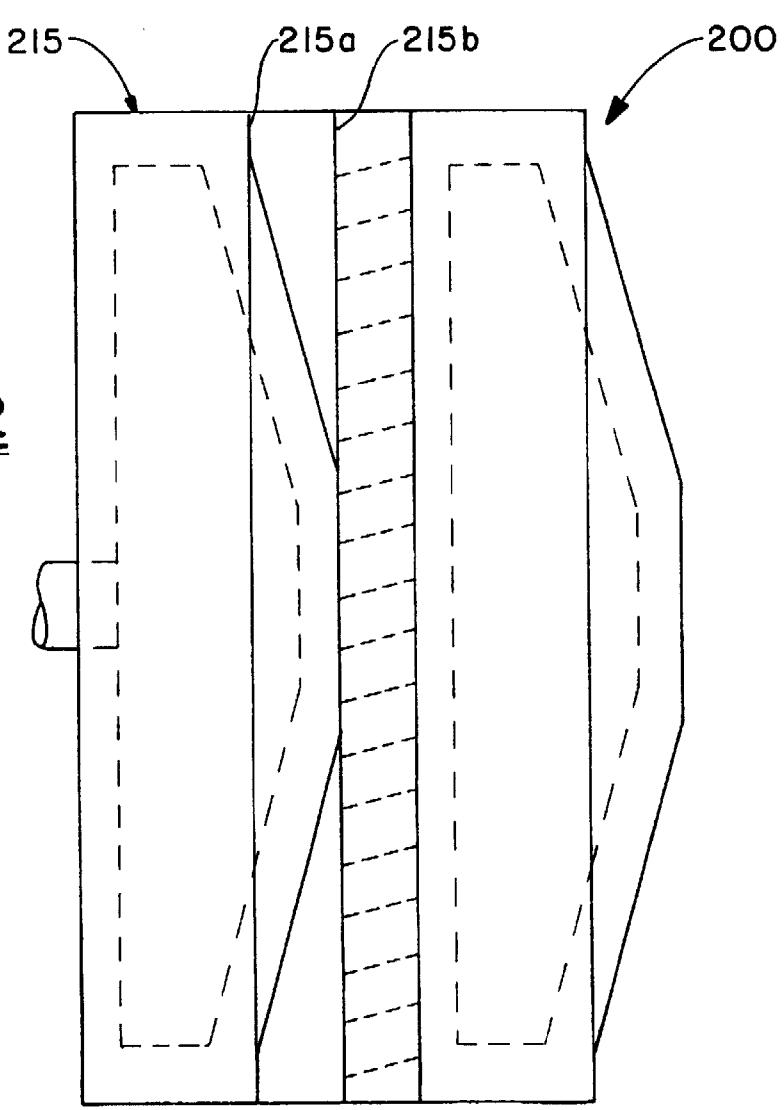
FIG.-2
Prior Art
FIG.-1
Prior Art
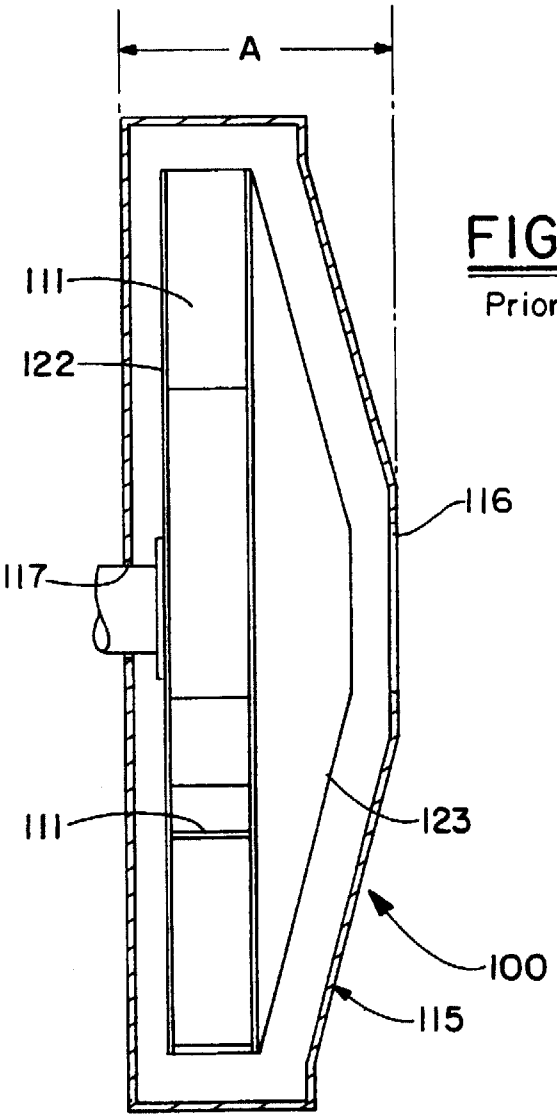

ROTATING FAN HAVING TAPERED DISK COMPONENT

This is a continuation of application Ser. No. 08/344,144 filed Nov. 23, 1994, now abandoned.

TECHNICAL FIELD

The invention herein resides in the art of rotating fans. More particularly, the invention relates to such rotating fans having a tapered cross-section. Specifically, the invention relates to such fans having a tapered disk component.

BACKGROUND ART

Heretofore it has been known that the overall performance of rotating fans may be improved by utilizing multi-stage fan systems which incorporate rotating fans in combination with stationary fans. In such assemblies, each stationary fan is interposed between the rotating fans, so that air moving from the outlet of one rotating fan toward the inlet of the other rotating fan is passed through the stationary fan so as to defuse the air and ease the transitional flow of air from one rotating fan to the other. It has been found that the use of such stationary fans reduce eddy currents and allows for more efficient operation. Such systems are capable of achieving greatly increased efficiency over single fan systems. Previously, rotating fans were comprised of a flat disk member, and a flat ring member with a plurality of blade members interposed between the ring and the disk. The desire to optimize both the fan inlet characteristics and the fan exhaust characteristics led to the development of tapered fans. The conventional tapered fan design utilizes a rotating fan member 100 having tapered fan ring 123 and a flat fan disk 122 with blades 111 interposed therebetween as shown in prior art FIG. 1. The shell 115 includes an inlet 116 for drawing air into the rotating fan and an outlet 117 for exhausting the air, wherein a fan shaft extends through the outlet. Such designs have succeeded in improving overall fan performance and in reducing the noise associated with such rotating fans. However, it has been found that such tapered fans, require the use of tapered shells 115 resulting in an increased case length from the fan shell to the inlet plane as designated by dimension "A" in prior art FIG. 1. Further, the need for a tapered fan shell 215 for use in conjunction with a tapered fan 200 in multi-stage combinations mandate the use of two shells 215*a* and 215*b* as shown in prior art FIG. 2. One shell 215*a* providing proper rotating fan shrouding and the other 215*b* used in a conventional stationary design.

Accordingly, it is most desirable to obtain a tapered rotating fan assembly having a reduced case length from the start of the fan shell to the plane of the inlet, and requiring only one fan shell for two stage stationary fan systems while reducing production and packaging cost as well as simplifying shell design and cost.

DISCLOSURE OF INVENTION

In light of the foregoing, it is an aspect of the invention to provide a rotating fan assembly having a tapered rotating fan member so as to increase fan performance.

Another aspect of the invention is the provision of a rotating fan assembly having a reduced case length from the start of the fan shell to the plane of the inlet.

Yet an additional aspect of the invention is the provision of a rotating fan assembly which employs a fan shell having a flat face, thereby reducing production design materials handling, and packaging costs as well as requiring only one shell in two-stage designs.

The foregoing and other aspects of the invention which will become apparent as the detailed description proceeds are achieved by the improvement in a rotating fan member comprising: a tapered fan disk member having a frusto-conical shape; an annular fan ring member; and a plurality of tapered blade members fixedly interposed between the fan disk member and the fan ring member.

Other aspects of the invention are attained by a single stage rotating fan assembly comprising: a tapered fan housing case member; a rotating fan member rotatably disposed within the tapered housing case member, the fan member having a frusto-conical tapered disk member, a flat annular ring member and a plurality of tapered blade members interposed between the disk member and the ring member; and a flat shell member matably received on the tapered fan housing case member.

Still other aspects of the invention are attained by a two stage rotating fan assembly comprising: a tapered fan housing case member; a rotating fan member rotatably disposed within the tapered fan housing case member, the rotating fan member having a frusto-conical tapered disk member, an annular ring member and a plurality of tapered blade members interposed between the disk member and the ring member; a flat shell member matably received on the tapered fan housing case member; and a stationary fan member abutting the flat shell member such that the shell member provides shrouding for both the rotating fan member and the stationary fan member.

DESCRIPTION OF THE DRAWINGS

For a complete understanding of the objects, techniques and structure of the invention, reference should be made to the following detailed description and accompanying drawings wherein:

FIG. 1 is an elevational view showing a conventional prior art fan assembly;

FIG. 2 is an elevational view showing a conventional two-stage prior art fan assembly;

BEST MODE FOR CARRYING OUT THE INVENTION

Figure 4:
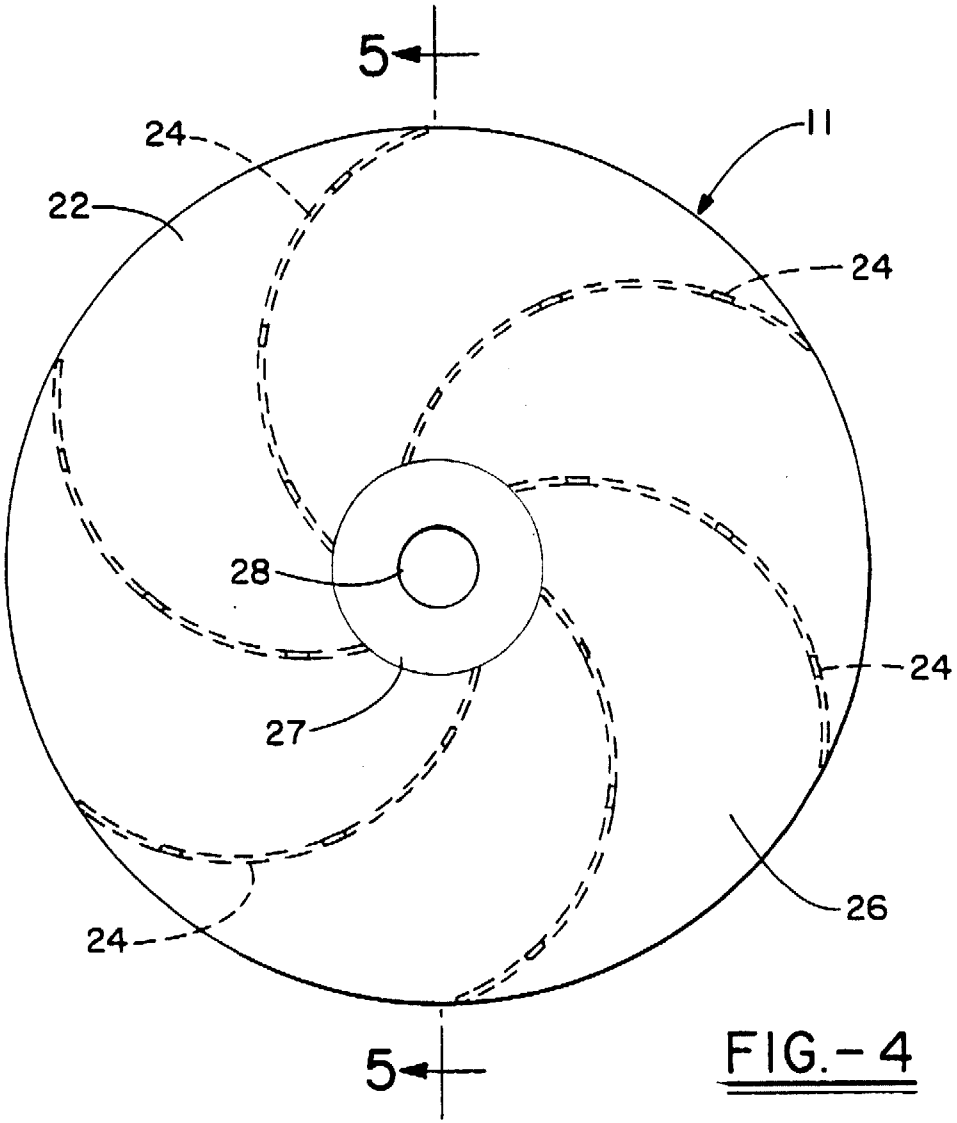
FIG. 4 is a top plan view of a rotating fan member according to the concepts of the present invention.
Figure 3:
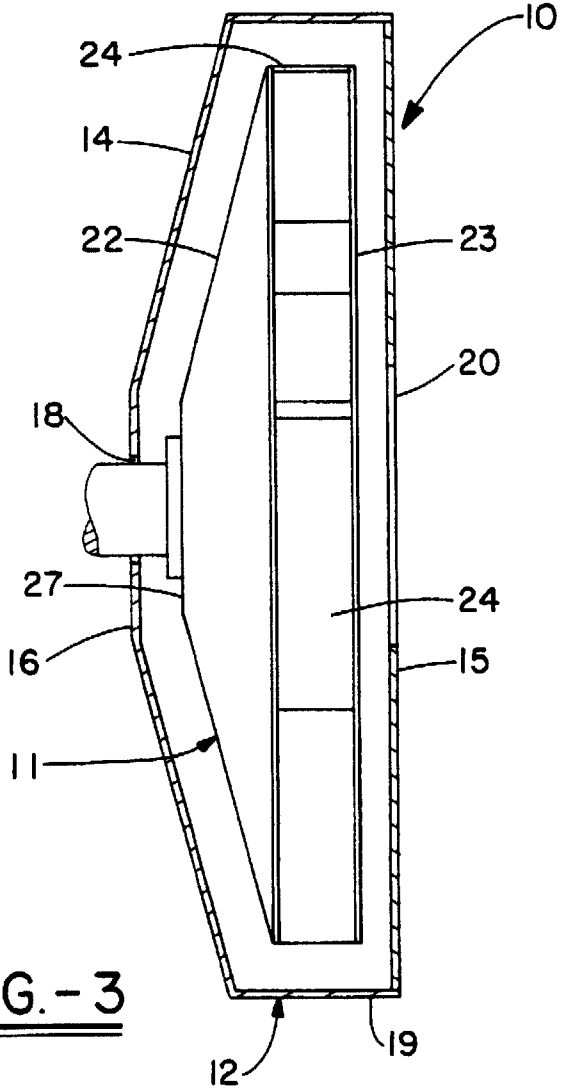
FIG. 3 is an elevational view, in parallel cross-section, of a fan assembly embodying the concepts of the present invention.

Referring now to the drawings and more particularly to FIG. 3, it can be seen that a rotating fan assembly according to the concept of the present invention is designated generally by the numeral 10. While it will be appreciated that the concept of the invention is applicable to any rotating fan, the description herein will be with respect to a fan assembly of the nature shown. In such a device, a rotating fan member 11 is housed in an enclosure shroud 12. The enclosure shroud 12 includes a case member 14 and a shell member 15. As shown, an end wall 16 of the case member 14 is tapered such that it has a frusto-conical shape. The end wall 16 further includes a shaft receiving aperture 18. A generally circumferential side wall 19 extends axially from the end wall 16.

The shell member 15 is generally disk shaped having a circumference closely approximating that of the side wall 19. The shell member 15 also includes a central air inlet aperture 20. The shell member 15 is matably received in the case member 14 so as to enclose the fan member 11.

Figure 6:
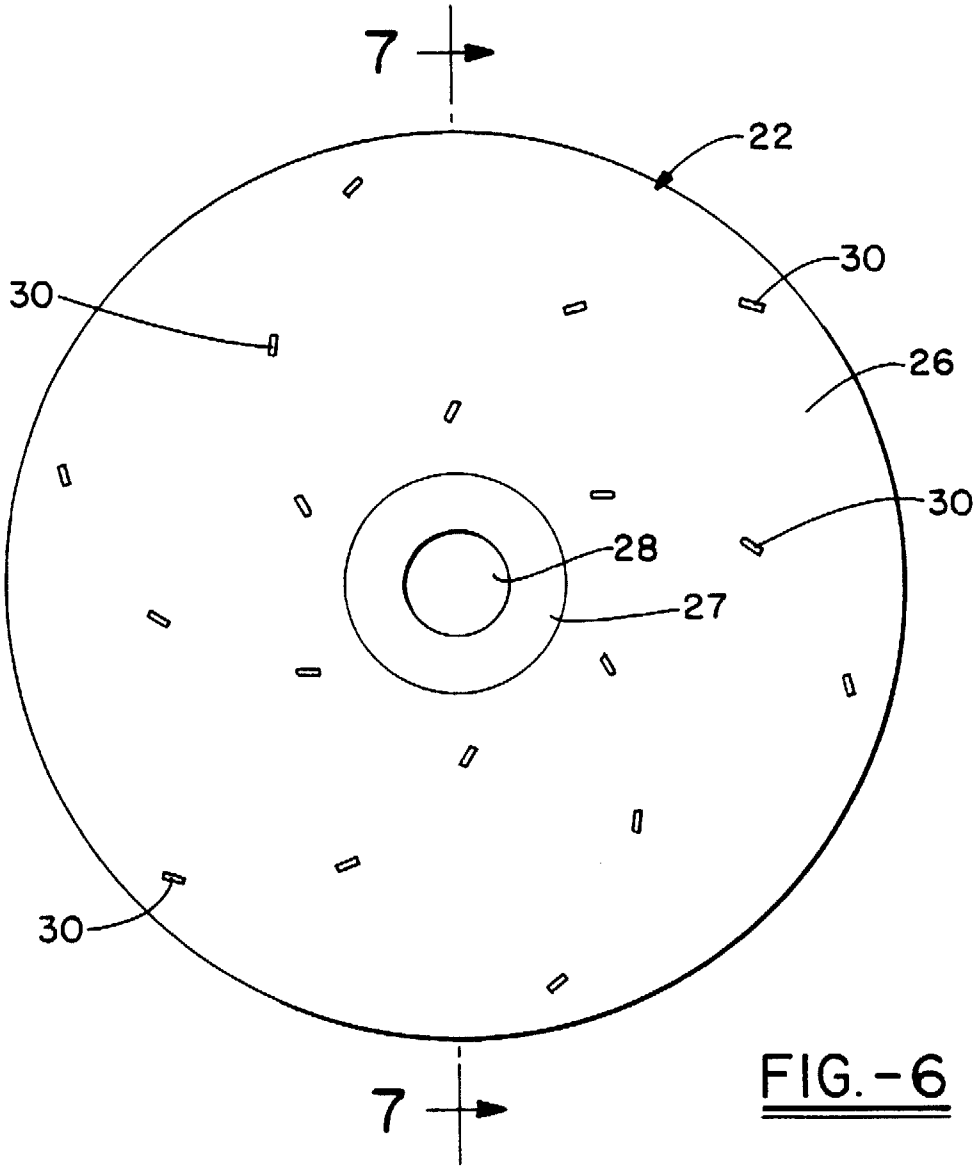
FIG. 6 is a top plan view of the novel disk member of the present invention.
Figure 5:
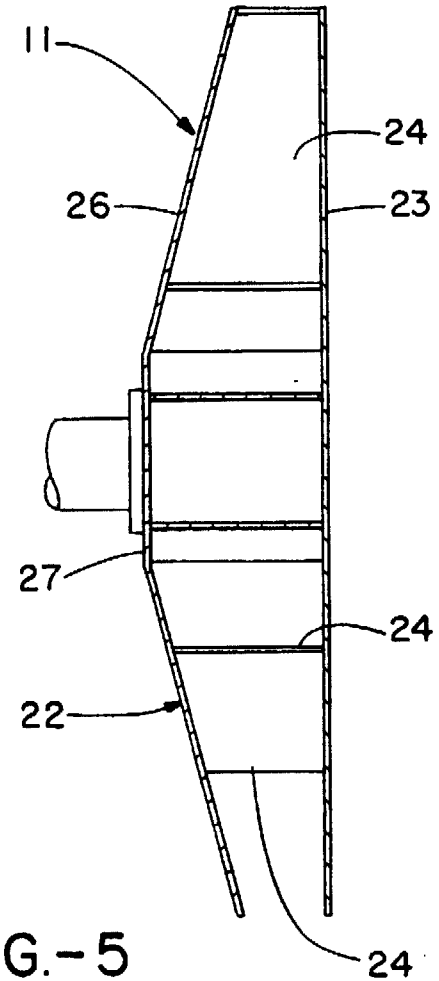
FIG. 5 is a partial cross-sectional view of the fan member of FIG. 4 taken along the line 5—5.
Figure 7:
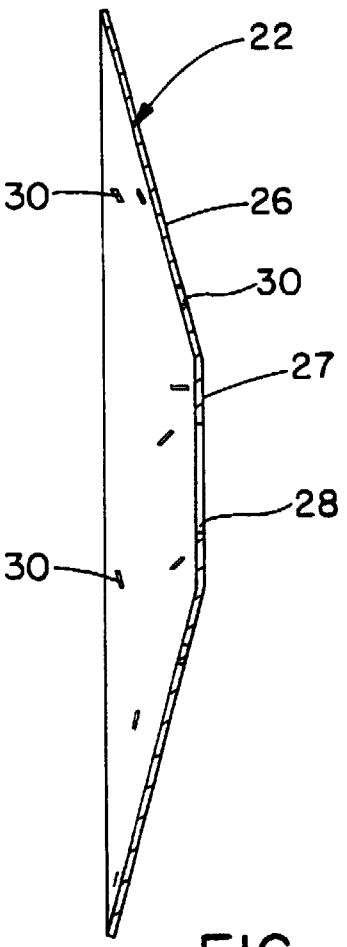
FIG. 7 is a cross-sectional view of the disk member of FIG. 6 taken along the line 7—7.

With continued reference to FIG. 3 and also to FIGS. 4–11 it can be seen that the fan member 11 is comprised generally of a fan disk member 22, a fan ring member 23 and a plurality of fan blade members 24. The disk member 22 is a generally annular member, preferably formed from an appropriate aluminum or other similar material. As is best seen in FIGS. 5, 6 and 7, a portion 26 of the disk member 22 is circumferentially tapered resulting in a disk member 22 having a frusto-conical shape. The disk member 22 is further defined by a central shaft plane 27. As can be seen, the shaft plane 27 is flat relative to the surrounding tapered portion 26. Further, a shaft aperture 28 is centered within the shaft plane 27. As is best shown in FIG. 6, the disk member 22 further includes a plurality of blade stake apertures 30 which penetrate the tapered portion 26.

Figure 8:
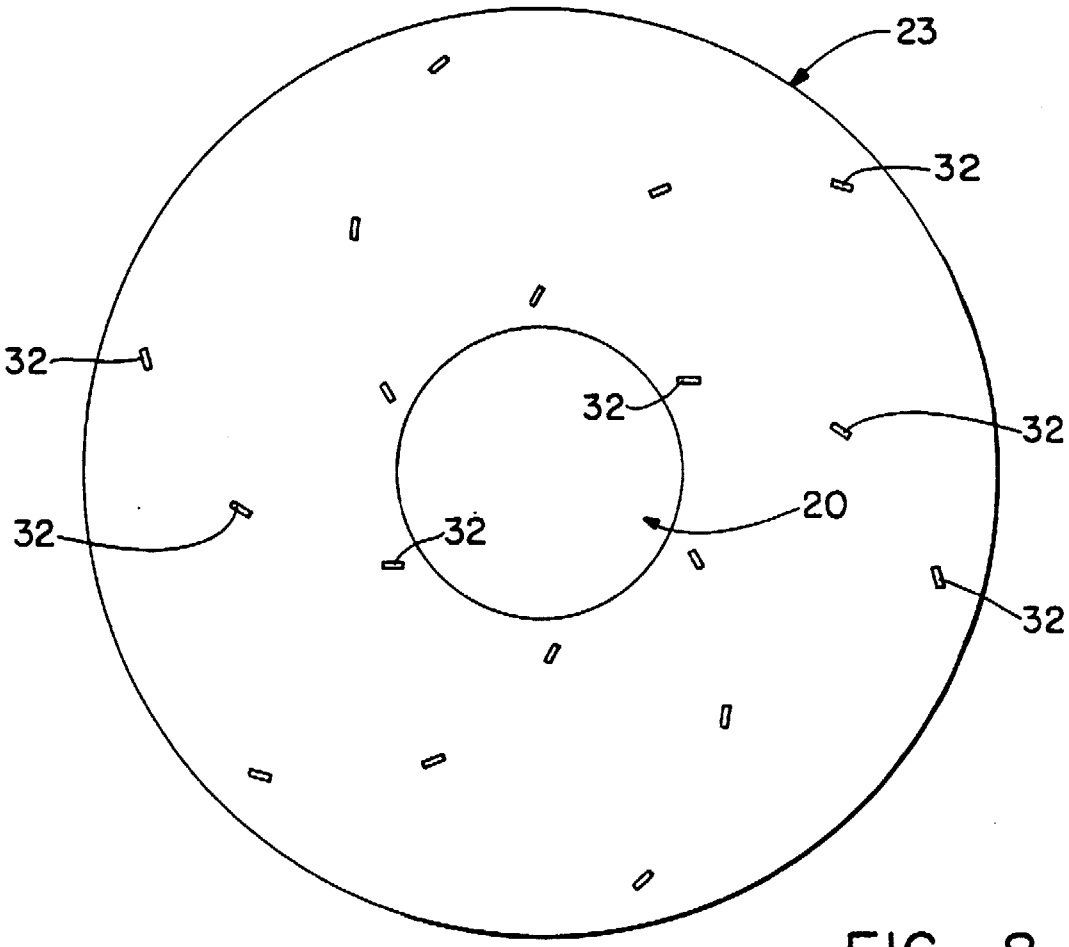
FIG. 8 is a top plan view of the ring member of the present invention.

The fan ring member 23 is similar in many respects to the disk member 22 previously described. With particular reference to FIGS. 5 and 8 it can be seen that the ring member 23 is a flat annular disk shaped member having a circumference approximating that of the disk member 22. Further, the ring member 23 includes a central air inlet aperture 31 having a diameter approximately one third that of the outside diameter of the ring 23. A plurality of blade stake apertures 32 penetrate the ring member 23.

Figure 9:
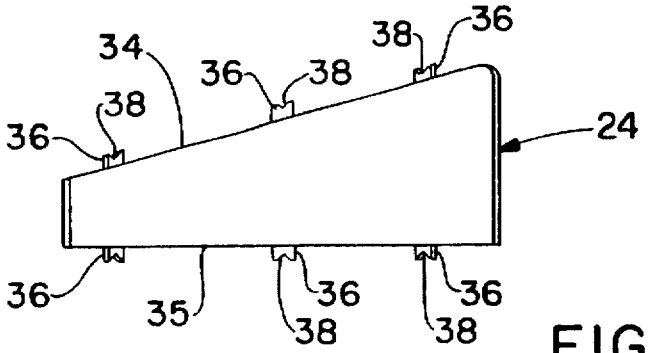
FIG. 9 is an elevational view of a blade member of the present invention.
Figure 10:
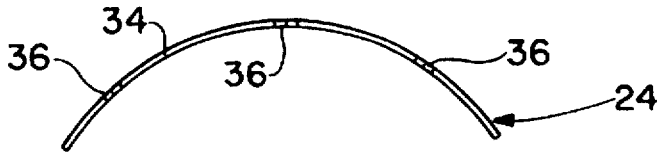
FIG. 10 is a top plan view of the blade of FIG. 9.

Referring now to FIGS. 9 and 10, a representative fan blade member 24 is depicted. The blade members 24 may be manufactured from the same material as the ring 23 and disk 22. As is best shown in FIG. 9, the blade member 24 has a tapered upper surface 34 and a flat lower surface 35. For reasons which will become apparent as the description proceeds, the angle of the tapered upper surface 34 approximates that of the tapered portion 26 of the disk member 22. The tapered upper surface 36 and flat lower surface 35 each include a plurality (preferably three) of stake tabs 36. Each stake tab 36 extends outwardly from the surfaces 34 and 35. It is preferred that a tab 36 be located at the mid-point along the length of each surface 34 and 35 and that tabs 36 be included at equal distances from the mid-point proximal to the ends of the blade member 24. It can further be seen that each tab 36 includes a V-shaped notch 38. As shown in FIG. 10 each blade member 24 is curvilinearly formed into an arc.

The fan member 11 is assembled with the blade members 24 interposed between the disk member 22 and the ring member 23. The tapered upper surface 34 of each blade member 24 is matably received in the underside of the tapered portion 26 of the disk member 22. A plurality of blades 24 are arranged in a curved sunburst pattern radiating outwardly from the air inlet aperture 31 of the ring member 23. Accordingly, the stake apertures 30 and 32 of the disk 22 and ring 23 respectively, are arranged in a similar curved sunburst pattern so as to receive the stake tabs 36 of the blade member 24. The stake tabs 36 may then be staked so as to affix permanently the blade member 24 to both the ring member 23 and the disk member 22. The staking process is facilitated by the V-shaped notches 38 which allow the tabs 36 to be crimped.

The assembled fan member 11 may then be housed in the enclosure shroud 12. The fan member 11 is mounted in the enclosure 12 such that the frusto-conical disk member 22 is adjacent to the frusto-conical case member 14 while the flat ring member 23 is adjacent to the flat shell member 15. Accordingly, the shaft aperture 28 of the disk 22 is aligned with the shaft aperture 18 of the case 14, and the air inlet aperture 31 of the ring 23 is aligned with the air inlet aperture 20 of the shell 15.

As is best shown in FIG. 3, the novel arrangement of the present invention dramatically reduces the case length from the inlet plane to the start of the shell, designated as dimension "A" in the drawings, compared with the prior arrangement depicted in FIG. 1.

Figure 11:
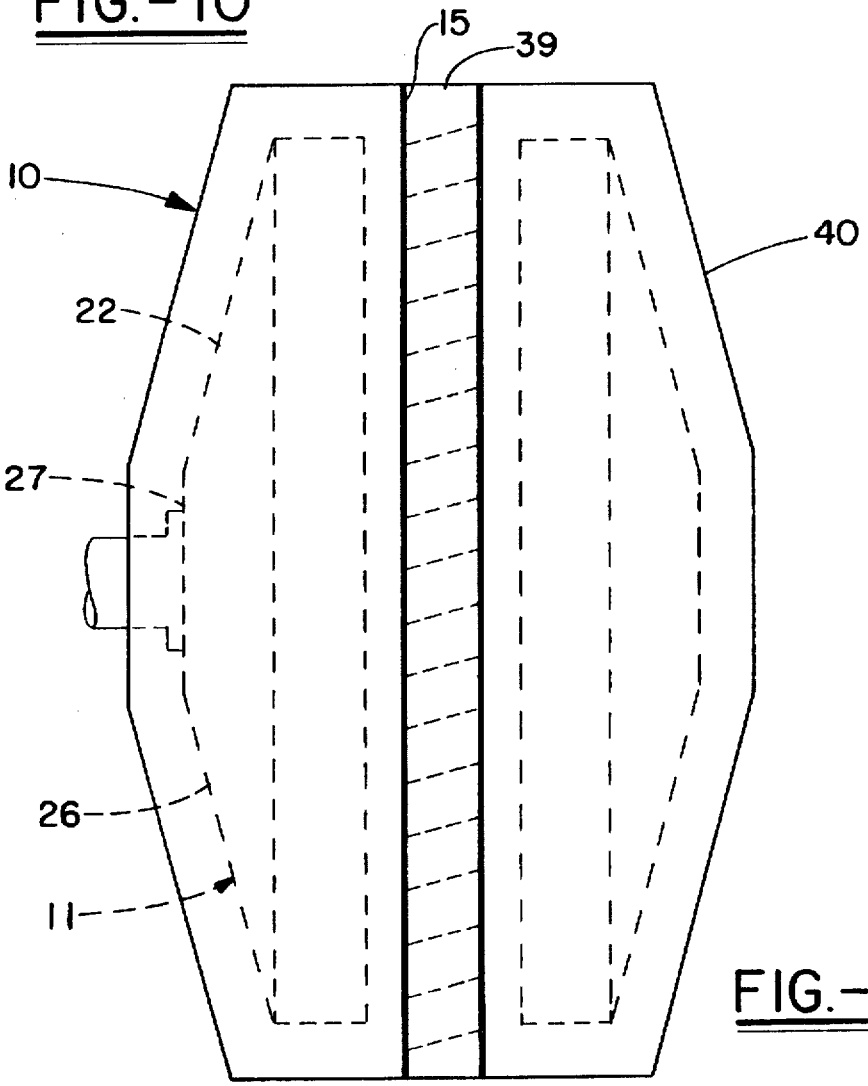
FIG. 11 is an elevational view of a two-stage fan assembly embodying the concepts of the present invention.

Referring now to FIG. 11, the fan assembly 10 is depicted in a two stage arrangement in conjunction with a stationary fan 39 and a conventional tapered fan assembly 40. When the novel arrangement of FIG. 11 is compared with the prior art two stage arrangement depicted in FIG. 2 the benefits of the invention become readily apparent. Specifically, the present invention's use of the tapered disk member 22 and flat ring member 23 permit the use of a flat shell member 15 as described above. Accordingly, when the assembly 10 is used in a two stage system as depicted, the flat shell member 15 serves a dual purpose by acting as a shell for the stationary fan 39, while providing proper rotating fan shrouding. Accordingly, the use of two shells, as depicted in prior art FIG. 2 is no longer necessary.

Thus, it can be seen that the objects of the invention have been satisfied by the structure presented above. While in accordance with the patent statutes, only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A rotating fan member comprising:

a tapered fan disk member having a frusto-conical shape, said tapered fan disk member having a flat shaft plane portion, a circumferentially tapered portion extending at an oblique angle from said shaft plane portion, a shaft aperture in said shaft plane portion, and a plurality of blade stake apertures in said circumferentially tapered portion;

a flat annular fan ring member having a central air inlet aperture therethrough; and a plurality of tapered blade members fixedly interposed between said fan disk member and said fan ring member.

2. A rotating fan member according to claim 1, wherein said annular fan ring member comprises a flat disk shaped member having a central air inlet aperture therein and a plurality of blade stake apertures incorporated therein.

3. A rotating fan member according to claim 2, wherein each of said plurality of tapered blade members comprise:

a tapered first surface having a plurality of stake tabs extending therefrom, each of said plurality of stake tabs having a V-shaped notch incorporated therein; and a flat second surface having a plurality of stake tabs extending therefrom, each of said plurality of stake tabs in said second surface also having a V-shaped notch incorporated therein, so that when said plurality of tapered blade members are interposed between said disk member and said ring member, said tapered first surface abuts said circumferentially tapered portion of said disk member and said flat second surface abuts said flat ring member and said stake tabs matingly engage said blade stake apertures of said disk member and said ring member, and said V-shaped notches of said stake tabs are crimped fixedly to engage said disk member and said ring member.

4. A rotating fan assembly comprising:

a fan housing case member having a shaft aperture therethrough;

a fan member rotated by a shaft extending through said shaft aperture and disposed within said housing case member, said fan member having a frusto-conical tapered disk member that has a flat shaft plane portion, a circumferentially tapered portion extending at an oblique angle from said shaft plane portion and a shaft aperture in said shaft plane portion, said fan member further having a flat annular ring member with a central air inlet aperture therethrough and a plurality of tapered blade members interposed between said disk member and said ring member; and a flat shell member having an aperture wherein said flat shell member is positioned substantially parallel to said flat annular ring member matably received on said fan housing case member.

* * * * *